US010799049B2

(12) United States Patent
Wendling

(10) Patent No.: US 10,799,049 B2
(45) **Date of Patent: *Oct. 13, 2020**

(54) APPARATUS TO PREVENT CURLING OF A RUG CORNER

(71) Applicant: Allan Wendling, New Lothrop, MI (US)

(72) Inventor: Allan Wendling, New Lothrop, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/454,533

(22) Filed: Jun. 27, 2019

(65) Prior Publication Data

US 2019/0313823 A1 Oct. 17, 2019

Related U.S. Application Data

(63) Continuation of application No. 15/802,588, filed on Nov. 3, 2017, now Pat. No. 10,368,675, which is a continuation-in-part of application No. 15/196,139, filed on Jun. 29, 2016, now Pat. No. 10,357,122, which is a continuation-in-part of application No. 14/730,849, filed on Jun. 4, 2015, now abandoned, which is a continuation-in-part of application No. 14/542,774, filed on Nov. 17, 2014, now abandoned.

(51) Int. Cl.
*A47G 27/04* (2006.01)

(52) U.S. Cl.
CPC ..... *A47G 27/0418* (2013.01); *A47G 27/045* (2013.01); *A47G 27/0431* (2013.01); *Y10T 428/14* (2015.01)

(58) Field of Classification Search
CPC ..... C09J 7/02; C09J 7/0225; C09J 2203/314; A47G 27/0431; A47G 27/0418; A47G 27/045; B23B 38/10; Y10T 428/14; Y10T 16/14
See application file for complete search history.

(56) References Cited

U.S. PATENT DOCUMENTS

| | | | | |
|---|---|---|---|---|
| 922,703 | A | 5/1909 | Knapp | |
| 1,509,047 | A | 9/1924 | Lindhorst | |
| 3,559,273 | A | 2/1971 | Samaris et al. | |
| 4,681,786 | A | 7/1987 | Brown | |
| 5,003,664 | A | 4/1991 | Wong | |
| 6,673,409 | B1 | 1/2004 | Wheatley | |
| 10,357,123 | B2 | 7/2019 | Wendling | |
| 10,368,675 | B2 * | 8/2019 | Wendling | A47G 27/045 |
| 2005/0025926 | A1 | 2/2005 | Risi et al. | |
| 2006/0127628 | A1 | 6/2006 | Price | |

(Continued)

FOREIGN PATENT DOCUMENTS

| | | | |
|---|---|---|---|
| GB | 264447 | A | 2/1927 |
| GB | 2282965 | A | 4/1995 |

*Primary Examiner* — Patricia L. Nordmeyer
(74) *Attorney, Agent, or Firm* — Dinsmore & Shohl LLP

(57) ABSTRACT

An apparatus to prevent curling of a rug corner. The apparatus includes a rigid and planar V-shaped body having a top surface and a bottom surface. An adhesive layer is applied to at least a portion of the top surface of the body while a removable protective cover is provided over the adhesive layer. Upon removal of the protective cover and exposure of the adhesive layer, the body is adhered to the rug corner by the adhesive. Upon doing so, the body maintains the rug corner in a flat condition thus preventing any curling of the rug.

20 Claims, 3 Drawing Sheets

(56) References Cited

U.S. PATENT DOCUMENTS

| | | | |
|---|---|---|---|
| 2011/0074128 | A1 | 3/2011 | Chang |
| 2012/0285613 | A1 | 11/2012 | Bongiovanni et al. |
| 2014/0141204 | A1 | 5/2014 | Calkins |
| 2016/0029826 | A1 | 2/2016 | Bongiovanni et al. |
| 2019/0313824 | A1 | 10/2019 | Wendling |
| 2019/0313825 | A1 | 10/2019 | Wendling |

* cited by examiner

APPARATUS TO PREVENT CURLING OF A RUG CORNER

CROSS-REFERENCE TO RELATED APPLICATIONS

This application is a continuation of U.S. patent application Ser. No. 15/802,588 filed on Nov. 3, 2017, which is a continuation-in-part of U.S. patent application Ser. No. 15/196,139 filed Jun. 29, 2016 which is a continuation-in-part of U.S. patent application Ser. No. 14/730,849 filed Jun. 4, 2015, which is a continuation-in-part of U.S. patent application Ser. No. 14/542,774 filed Nov. 17, 2014.

BACKGROUND OF THE INVENTION

I. Field of the Invention

The present invention is related to a device for preventing curling of a rug corner.

II. Description of Related Art

Many homes, office buildings, and the like use area rugs on the floor for decorative or other purposes. These area rugs are typically rectangular in shape and ideally lie flatly on the floor surface.

Unfortunately, over time, the corners of the rug curl upwardly away from the floor surface. When this occurs, the upwardly curled corner of the rug is not only visually unattractive but also presents a safety hazard in which people can trip on the corner of the rug. This is particularly serious in commercial establishments where people who trip on the upwardly curled corner of the rug may fall and hurt themselves and create legal and financial liability.

SUMMARY OF THE PRESENT INVENTION

The present invention provides an apparatus to prevent curling of a rug corner that overcomes all of the above-mentioned disadvantages of the prior art.

In brief, the apparatus of the present invention comprises a rigid and planar V-shaped body. The body has a planar top and a planar bottom which is spaced from the planar top by a small distance, e.g. one eighth of an inch.

An adhesive layer is applied to at least a portion of the top of the body. A removable protective cover is then provided over the adhesive layer to protect the adhesive layer when the apparatus of the present invention is not in use.

When use of the device of the present invention is desired, the protective cover for the adhesive layer is removed. The body is then adhered to the bottom of the rug corner by the adhesive layer. Upon doing so, the rigid and planar V-shaped body maintains the rug corner in a flat condition. Consequently, when the rug corner is again laid on the ground surface, the body is positioned between the floor and the rug corner and not only provides an anti-slip protection for the rug, but also prevents curling of the rug corner.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
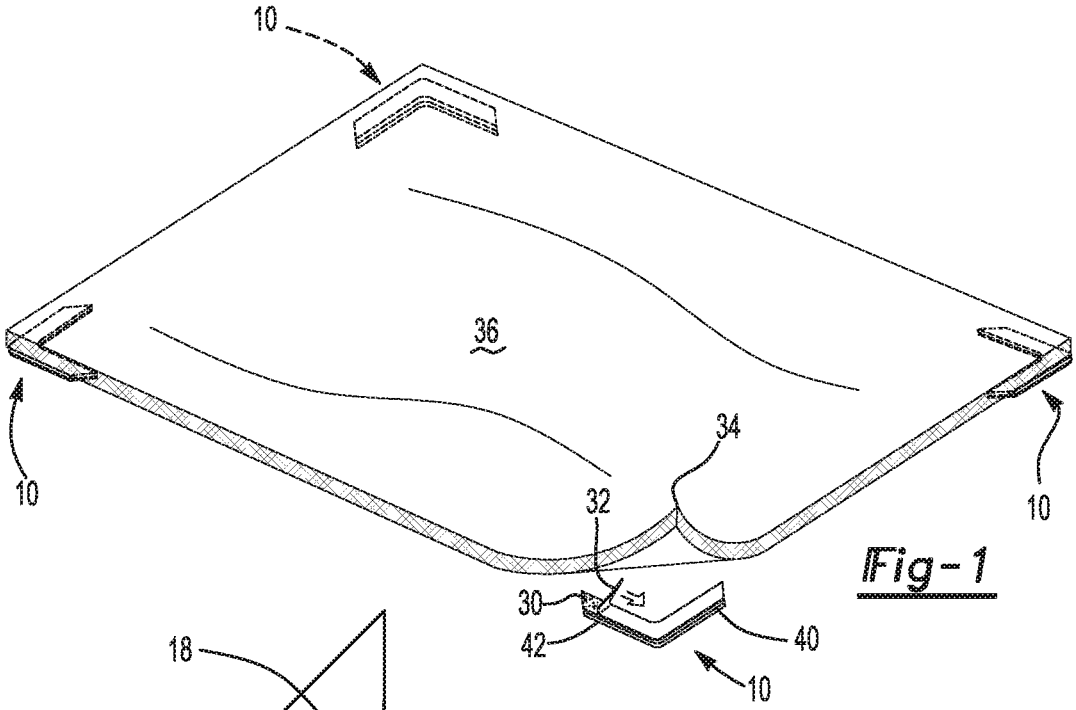
FIG. 1 is an elevational view illustrating the application of the device of the present invention.
Figure 2:
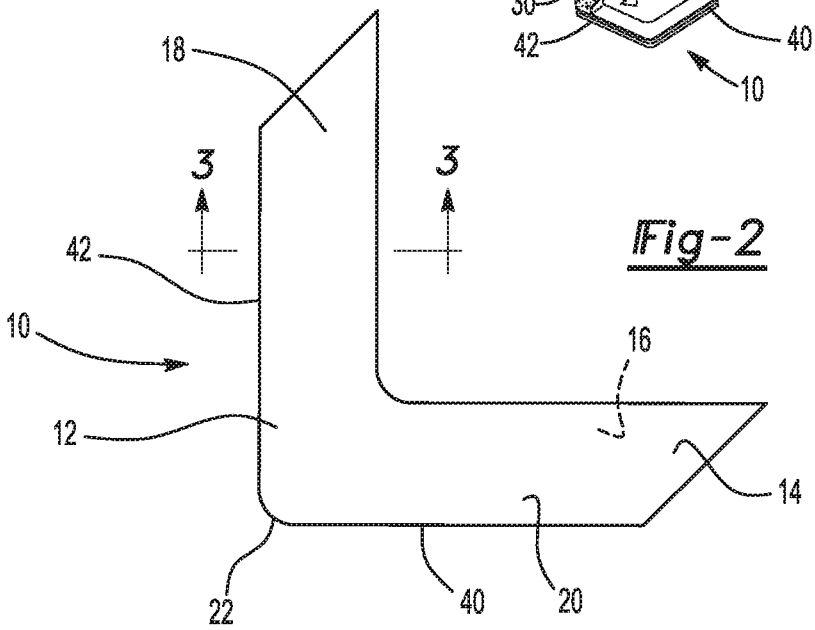
FIG. 2 is a top view illustrating a preferred embodiment of the present invention.

With reference first to FIGS. 1 and 2, a preferred embodiment of the apparatus 10 to prevent curling of a rug corner is shown. The apparatus 10 includes a V-shaped body 12 with a top 14 and bottom 16. The body 12, furthermore, includes two elongated legs 18 and 20 which intersect together generally perpendicularly and with a rounded nose 22.

Figure 3:
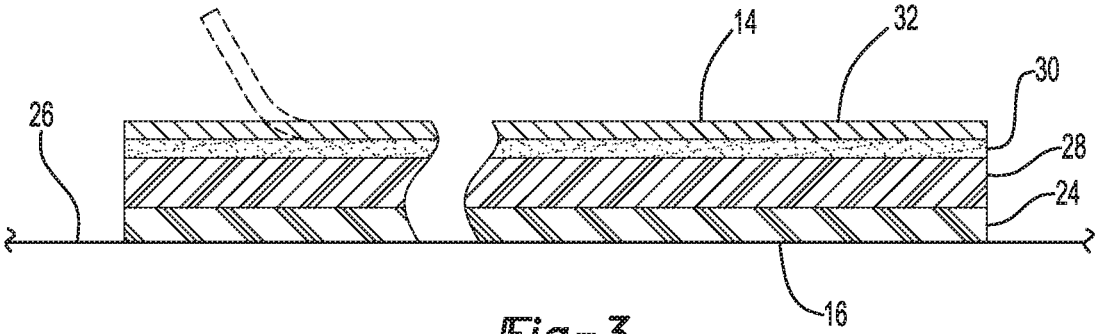
FIG. 3 is a sectional view taken along line 3-3 in FIG. 2 and enlarged for clarity.

As best shown in FIG. 3, the body is a laminate structure and comprises a bottom elastomeric layer 24 of an elastomeric material. This elastomeric material is adapted to abut against a floor surface 26 and, in doing so, prevents slippage between the apparatus 10 and the floor surface 26.

A plastic layer 28, preferably made of polypropylene copolymer, overlies the bottom elastomeric layer 24. The plastic layer 28 is preferably made of a rigid plastic material and maintains the entire body 12 in a rigid form. The plastic layer 28 and elastomeric layer 24 are preferably approximately one eighth of an inch in thickness and are attached together in any conventional fashion. Preferably, the elastomeric layer 24 comprises a sticky gel (polyurethane gel) covered by a removable backing. Alternatively, the bottom layer comprises a synthetic rubber layer such as Santoprene® by ExxonMobil Corporation. Both layers 24 form an anti-slip layer for the rug.

Alternatively, the bottom layer 24 is made of a sticky gel. The sticky gel adheres to the floor to prevent slippage, but without marring or otherwise damaging the floor surface 26.

A thin adhesive layer 30, such as 3M adhesive (acrylic foam tape), is then provided over at least a portion of the plastic layer 28. This adhesive layer 30 is then covered by a protective cover 32, preferably made out of paper or a synthetic material, and which remains attached to the body 12 until use of the apparatus 10 is desired.

With reference now to FIG. 1, when use of the apparatus 10 is desired, the protective cover 32, preferably made of paper, is first removed from the body 12 thus exposing the adhesive layer 30. The body 12 is then aligned with a corner 34 of a rug 36 so that one edge 42 of the one leg 18 of the body 12 extends closely adjacent one edge of the corner 34 of the rug 36 while an edge 40 of the leg 20 of the body 12 extends closely adjacent another edge of the corner 34 of the rug 36.

By pressing the apparatus 10 and leg together, the apparatus 10 is thus adhered to the corner 34 of the rug. When this happens, the rigid and planar body 12 of the apparatus 10 maintains the corner in a flat condition. As the corner is then lowered onto the floor 28, the elastomeric layer 24 contacts the floor 28 and prevents slipping of the corner of the rug. Simultaneously, the rigid body 12 maintains the corner in a flat condition.

Figure 4:
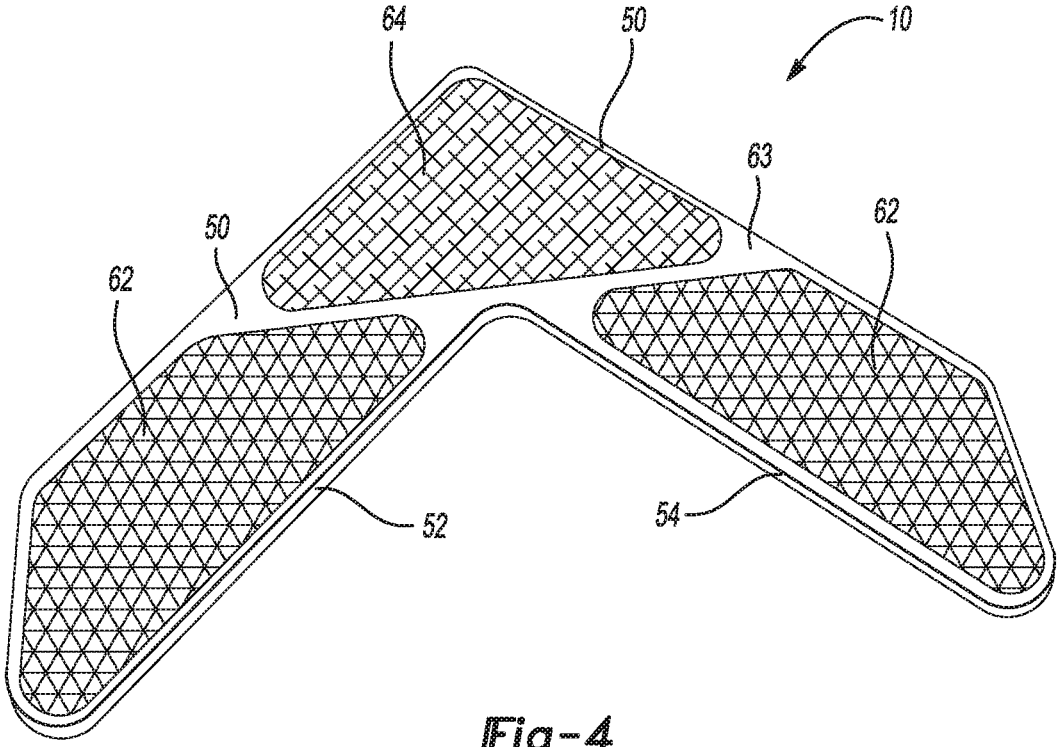
FIG. 4 is a perspective view of a further embodiment of the invention.

With reference now to FIG. 4, a further embodiment of the apparatus 10 to prevent curling of the rug corner is shown. The apparatus 10 includes a flat body 50 that is general L shaped thus having two legs 52 and 54. The L shaped body 50 may be constructed of any convenient material, such as polypropylene plastic.

Figure 5:
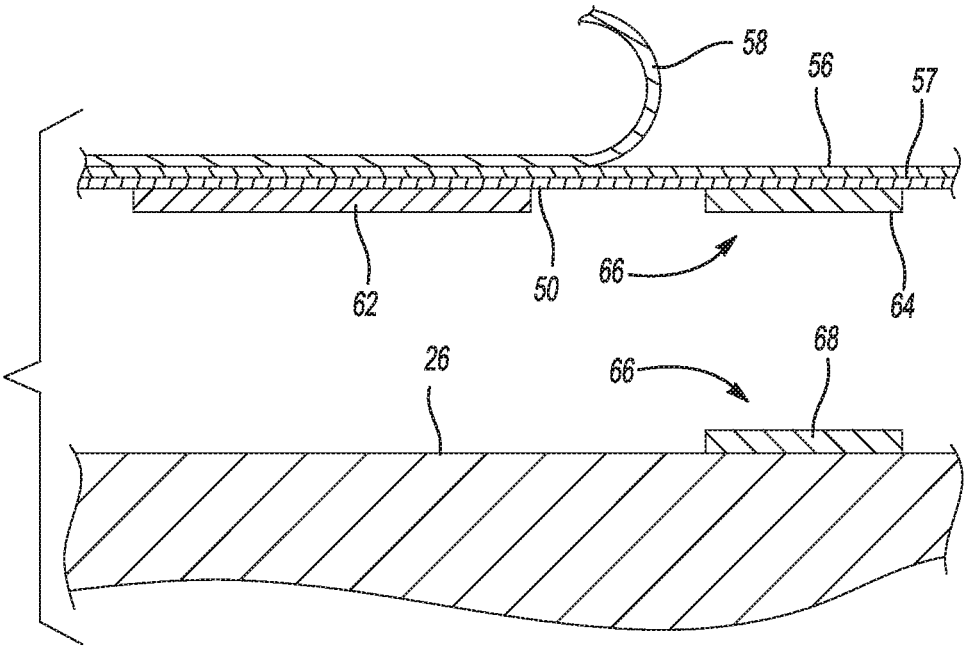
FIG. 5 is an exploded partial sectional view of the fastener.

As best shown in FIG. 5, an adhesive layer 56 overlies an upper side 57 of the L shaped backing 50. This adhesive layer 56 is preferably protected by a removable protective strip 58.

With reference now to FIGS. 4 and 5, an elongated foam strip 62 overlies the bottom 63 of each leg 52 and 54 of the L shaped body 50. These foam strips 62 may be attached to the body 50 in any convenient fashion, such as by an adhesive. Furthermore, each strip 62 stops short of the intersection of the two legs 52 and 54.

One half 64 of a loop and pile fastener 66 is attached to the body 50 in any conventional fashion, such as by an adhesive. Although the loop or pile fastener 66 is illustrated in FIG. 4 as being triangular in shape, it may assume any other shape without deviation from the spirit or scope of the invention.

As been show in FIG. 5, the complementary half 68 of the loop or pile fastener 66 is attached to the floor surface 26 in any conventional fashion so that the fastener half 68 is aligned with the fastener half 64. Any conventional means, such as a sticky gel material may be used to secure the fastener half 68 to the floor 26.

The two fasteners halves 64 and 68 are complementary to each other, i.e. one of them comprises a plurality of hooks while the other fastener 64 or 68 comprises the pile which cooperates to releaseably attach to the hooks. It doesn't matter if the fastener 64 is the hook or the pile, as long as it is the opposite from the fastener 66.

In use, the protective strip 58 is first removed from the body 50 then the body is adhered against the bottom of the rug at the corner of the rug. Preferably, the body 50 is positioned so that the legs 52 and 54 are positioned close to the edges on the rug adjacent rug corner.

The protected strip is also first removed from the fastener half 68 and the fastener half 68 is then positioned on the floor 26 so that the fastener half 68 registers with the cooperating fastener half 64. Once the two fasteners halves, 64 and 68 are pressed together, they attach to each other in the conventional fashion thus holding the corner of the rug in the desired position. However, if desired the rug may be moved by simply moving the rug as well as the fastener half 68 to a new location.

Figure 6:
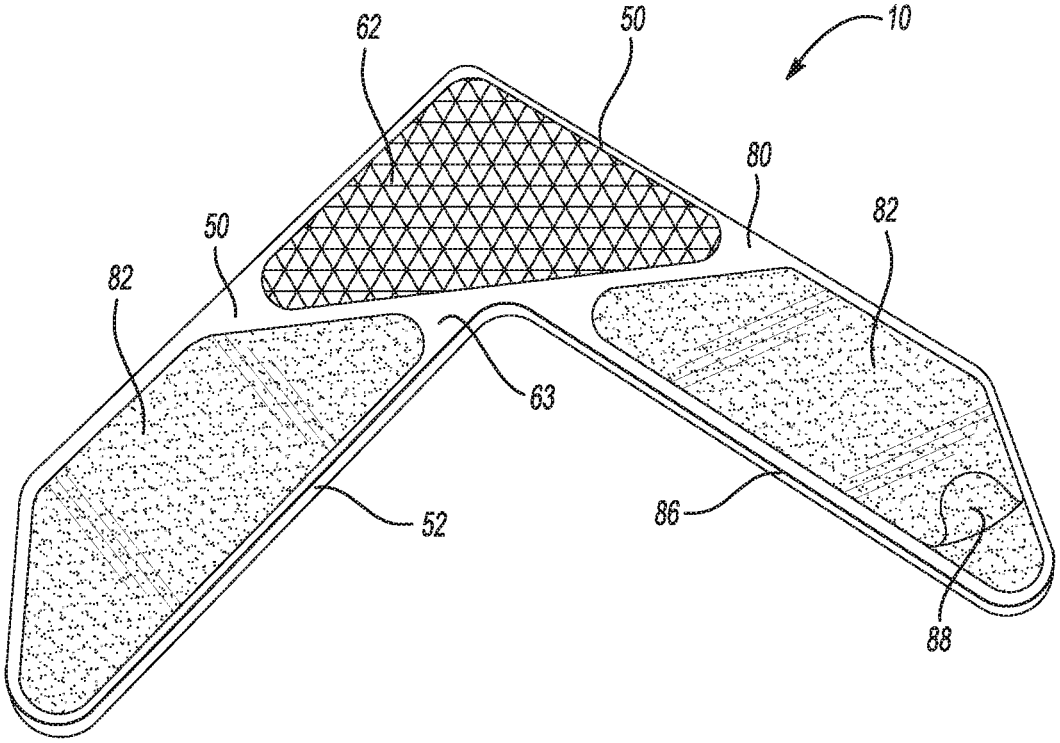
FIG. 6 is a perspective view showing a further preferred embodiment of the invention.

With reference now to FIG. 6, a still further modification of the present invention is shown in which, as before, an L shaped plastic body 80 is attached to the bottom of the rug adjacent to the corner in the previously described fashion. Therefore, that description is imported by reference and will not be repeated.

However, on the lower or downward facing side 63 of the body 80, a strip of polyurethane sticky gel 82 is attached to each leg 84 and 86 of the body 80. These two layers of sticky gel 82, furthermore, are preferably covered with a removable strip 88 which is removed just prior to use of the apparatus.

A section of eva foam 90 is then attached at the corner of the intersecting legs 84 and 86 of the body 80. Any conventional means, such as an adhesive, may be used to secure the foam 90 to the bottom of the backing 80.

In use, the apparatus 10 is attached to the corner of a rug so that the stick gel 82 adheres to the floor 26 and prevents the rug from slipping on the floor 26. The foam 90, however, facilitates to gripping and lifting the corner of the rug when desired.

From the foregoing, it can be seen that the present invention provides a simple yet effective apparatus for preventing curling of rug corners of area rugs. Having described my invention, however, many modifications thereto will become apparent to those skilled in the art to which it pertains without deviation from the spirit of the invention as defined by the scope of the appended claims.

I claim:

1. Apparatus to prevent curling of a rug corner away from a floor surface, the apparatus comprising:

a rigid and planar body having a planar top and planar bottom, an adhesive layer applied to at least a portion of said planar top of said body, a removable protective cover provided over said adhesive layer, a hook or pile fastener attached to said planar bottom of said body, and a complementary hook or pile fastener configured to be attached to the floor surface, wherein upon removal of said protective cover and exposure of said adhesive layer, said body is adhered to the rug corner by said adhesive whereby said body maintains the rug corner in a flat condition, and said hook or pile fastener and said complementary hook or pile fastener hold the rug corner in a desired position.

2. The apparatus as defined in claim 1 further comprising:

a first foam layer having a first surface and an opposite second surface, said first surface of said first foam layer contacting a first portion of said planar bottom, and said second surface of said first foam layer is configured to contact the floor surface, and a second foam layer having a first surface and an opposite second surface, said first surface of said second foam layer contacting a second portion of said planar bottom, and the second surface of said second foam layer is configured to contact the floor surface.

3. The apparatus as defined in claim 2, wherein said complementary hook or pile fastener comprises a sticky polyurethane gel layer on a bottom of said complementary hook or pile fastener, said sticky polyurethane gel layer configured to releasably secure said complementary hook or pile fastener to the floor surface.

4. The apparatus as defined in claim 2, wherein said first foam layer and said second foam layer are formed of an ethylene vinyl acetate foam.

5. The apparatus as defined in claim 4, wherein a portion of said planar bottom of said body is exposed between said hook or pile fastener and said first foam layer, and wherein a portion of said planar bottom of said body is exposed between said hook or pile fastener and said second foam layer.

6. The apparatus as defined in claim 4, wherein said first foam layer is spaced apart from said hook or pile fastener on said planar bottom of said body, and wherein said second foam layer is spaced apart from said hook or pile fastener on said planar bottom of said body.

7. The apparatus as defined in claim 1, wherein said complementary hook or pile fastener comprises a sticky polyurethane gel layer on a bottom of said complementary hook or pile fastener, said sticky polyurethane gel layer configured to releasably secure said complementary hook or pile fastener to the floor surface.

8. Apparatus to prevent curling of a rug corner away from a floor surface, the apparatus comprising:

a rigid and planar body having a planar top and planar bottom, an adhesive layer applied to at least a portion of said planar top of said body, a removable protective cover provided over said adhesive layer, a sticky polyurethane gel layer having a first surface and an opposite second surface, said first surface of said sticky polyurethane gel layer contacting said planar bottom of said body, and said second surface of said sticky polyurethane gel layer configured to contact the floor surface, and a foam layer having a first surface and an opposite second surface, said first surface contacting said planar bottom of said body, and said second surface configured to contact the floor surface, wherein upon removal of said protective cover and exposure of said adhesive layer, said body is adhered to the rug corner by said adhesive whereby said body maintains the rug corner in a flat condition, said second surface of said sticky polyurethane gel layer adheres to the floor surface to prevent the rug corner from slipping on the floor surface, and said foam layer facilitates gripping and lifting of the rug corner.

9. The apparatus as defined in claim 8, wherein said foam layer is formed of an ethylene vinyl acetate foam.

10. The apparatus as defined in claim 8, wherein said first surface of said sticky polyurethane gel layer contacts a first portion of said planar bottom of said body, and said first surface of said foam layer contacts a second portion of said planar bottom of said body, said second portion of said planar bottom of said body different from said first portion of said planar bottom of said body.

11. The apparatus as defined in claim 10, wherein said foam layer is formed of an ethylene vinyl acetate foam.

12. Apparatus to prevent curling of a rug corner away from a floor surface, the apparatus comprising:

a rigid and planar body having a planar top and planar bottom, said planar bottom having a first portion, a second portion, and an intermediate portion positioned between said first portion and said second portion, an adhesive layer applied to at least a portion of said planar top of said body, a removable protective cover provided over said adhesive layer, a sticky polyurethane gel layer having a first surface and an opposite second surface, said first surface of said first sticky polyurethane gel layer contacting one of said intermediate portion or said first portion and the second portion of said planar bottom of said body, and a foam layer having a first surface and an opposite second surface, said first surface of said foam layer contacting said other of said intermediate portion or said first portion and said second portion, and said second surface of said foam layer configured to contact the floor surface, wherein upon removal of said protective cover and exposure of said adhesive layer, said body is adhered to the rug corner by said adhesive whereby said body maintains the rug corner in a flat condition, said second surface of said sticky polyurethane gel layer adheres to the floor surface to prevent the rug corner from slipping on the floor surface, and said foam layer facilitates gripping and lifting of the rug corner.

13. The apparatus as defined in claim 12, wherein said foam layer is formed of an ethylene vinyl acetate foam.

14. The apparatus as defined in claim 12, wherein a portion of said planar bottom of said body is exposed between said first sticky polyurethane gel layer and said foam layer, and wherein a portion of said planar bottom of said body is exposed between said second sticky polyurethane gel layer and said foam layer.

15. The apparatus as defined in claim 12, wherein said first sticky polyurethane gel layer is spaced apart from said foam layer on said planar bottom of said body, and wherein said sticky polyurethane gel layer is spaced apart from said foam layer on said planar bottom of said body.

16. The apparatus as defined in claim 12, wherein said first portion and said second portion of said planar bottom of said body are spaced apart.

17. Apparatus to prevent curling of a rug corner away from a floor surface, the apparatus comprising:

a rigid and planar body having a planar top and planar bottom, an adhesive layer applied to at least a portion of said planar top of said body, a removable protective cover provided over said adhesive layer, a first sticky polyurethane gel layer having a first surface and an opposite second surface, said first surface of said first sticky polyurethane gel layer contacting a first portion of said planar bottom of said body, a second sticky polyurethane gel layer having a first surface and an opposite second surface, said first surface of said second sticky polyurethane gel layer contacting a second portion of said planar bottom of said body, and a foam layer having a first surface and an opposite second surface, said first surface of said foam layer contacting said planar bottom of said body between said first sticky polyurethane gel layer and said second sticky polyurethane gel layer, and said second surface of said foam layer configured to contact the floor surface, wherein upon removal of said protective cover and exposure of said adhesive layer, said body is adhered to the rug corner by said adhesive whereby said body maintains the rug corner in a flat condition, said second surface of said first sticky polyurethane gel layer and said second surface of said second sticky polyurethane gel layer adheres to the floor surface to prevent the rug corner from slipping on the floor surface, and said foam layer facilitates gripping and lifting of the rug corner.

18. The apparatus as defined in claim 17, wherein said foam layer is formed of an ethylene vinyl acetate foam.

19. The apparatus as defined in claim 18, wherein a portion of said planar bottom of said body is exposed between said first sticky polyurethane gel layer and said foam layer, and wherein a portion of said planar bottom of said body is exposed between said second sticky polyurethane gel layer and said foam layer.

20. The apparatus as defined in claim 18, wherein said first sticky polyurethane gel layer is spaced apart from said foam layer on said planar bottom of said body, and wherein said sticky polyurethane gel layer is spaced apart from said foam layer on said planar bottom of said body.

* * * * *